US006062043A

United States Patent [19]

Magnet et al.

[11] Patent Number: 6,062,043

[45] Date of Patent: May 16, 2000

[54] PROCESS FOR FEEDING A GAS-CONSUMING UNIT

[75] Inventors: Didier Magnet, Vincennes; Emmanuel Garnier, Paris; Bernard Saulnier, Colombes, all of France

[73] Assignee: L'Air Liquide, Societe Anonyme pour l'Etude et l'Exploitation des Procedes Georges Claude, Paris Cedex, France

[21] Appl. No.: 08/936,041

[22] Filed: Sep. 25, 1997

[30] Foreign Application Priority Data

Sep. 25, 1996 [FR] France ..... 96 11680

[51] Int. Cl.[7] ..... F25J 3/00; C21B 5/00

[52] U.S. Cl. ..... 62/643; 62/648; 75/466

[58] Field of Search ..... 62/643, 648, 644, 62/652, 653; 75/466

[56] References Cited

U.S. PATENT DOCUMENTS

| | | | |
|---|---|---|---|
| 3,129,080 | 4/1964 | Kohler | 62/643 |
| 4,655,809 | 4/1987 | Shenoy | 62/643 |
| 5,337,569 | 8/1994 | Darredeau | 62/643 |
| 5,538,534 | 7/1996 | Guillard et al. | 75/466 |

FOREIGN PATENT DOCUMENTS

| | | |
|---|---|---|
| 0 653 599 | 5/1995 | European Pat. Off. . |
| 42 19 160 | 12/1992 | Germany . |
| 61-139609 | 6/1986 | Japan . |

*Primary Examiner*—William Doerrler
*Attorney, Agent, or Firm*—Young & Thompson

[57] ABSTRACT

A gas-consuming unit (HF) is fed partially by a flow delivered directly by a compression unit (21) and partially by one delivered by a separation apparatus (25) which is itself fed by a flow delivered directly by the compression unit. Another flow produced by the separation apparatus, but at lower pressure, is returned to a compression unit before being sent to the consumer unit.

13 Claims, 4 Drawing Sheets

PROCESS FOR FEEDING A GAS-CONSUMING UNIT

BACKGROUND OF THE INVENTION

The present invention relates to process and to an installation for feeding a gas-consuming unit, and in particular a unit which consumes an air gas produced by an apparatus for the separation of air by cryogenic distillation.

DESCRIPTION OF THE RELATED ART

The conventional method of feeding a blast furnace is shown in FIG. 1. Air is sent to a compressor 3 and subsequently to a cryogenic separation unit 5. The oxygen which is produced is compressed in a compressor 7 and mixed with an air flow delivered by a blower 1, before being sent to the blast furnace HF.

JPL139609 (1986) describes (FIG. 2) a system in which an air separation apparatus 5 is fed by oxygen-enriched air delivered by the blower 1 of a blast furnace HF. The oxygen 4 produced by the low-pressure separation apparatus is sent to the intake of the blower.

The system only makes it possible to exploit the gas produced by the apparatus at a single pressure.

Furthermore, a part of the oxygen gas which is produced is recycled in the air recovery apparatus, and therefore circulates in a loop, which makes it necessary to upgrade the size of the equipment and also increases the energy consumption.

SUMMARY OF THE INVENTION

The object of the invention is to overcome the drawbacks of known processes and installations.

The present invention provides a process for feeding a gas-consuming unit (HF), in which:

i) a feed flow consisting of a gas mixture is compressed in a compression unit;

ii) a first part of the compressed mixture is sent to the unit (HF);

iii) a second part of the compressed mixture is sent to a separation apparatus which separates the mixture to produce two gas flows, one of which is at a higher pressure than the other;

iv) the gas flow at higher pressure is sent to the gas-consuming unit (HF), optionally while mixing it with the first part of the compressed mixture;

v) the other gas flow is sent to at least one compression unit, and the gas thus compressed is sent to at least one gas-consuming unit (HF, HF2, HF3).

Other aspects of the invention provide:

a process in which the feed flow is air and the gases produced by the separation apparatus are enriched either with respect to nitrogen or with respect to oxygen;

a process in which the two gas flows are sent to the same gas-consuming unit (HF);

another process, in which the gas-consuming installation (HF) is a blast furnace which consumes oxygen-enriched air.

The present invention also provides an installation for feeding a gas-consuming unit (HF), comprising:

a compression unit, a gas-consuming unit, a unit (25) for separating a gas mixture, means for sending a gas mixture to the compression unit, means (25) for sending a first part of the compressed mixture to the gas-consuming unit, means for sending a second part of the compressed mixture to the separation unit, means for sending a first gas, at higher pressure, to the gas-consuming unit (HF, HF1), and means for sending a second gas to at least one compression unit and subsequently to at least one gas-consuming unit (HF, HF2, HF3).

The invention could be applied to applications other than those described here. The gas-consuming unit could consume a gas other than oxygen, for example nitrogen or hydrogen. The separation unit could therefore produce nitrogen or hydrogen at a plurality of pressures.

DESCRIPTION OF THE PREFERRED EMBODIMENTS

Figure 3:
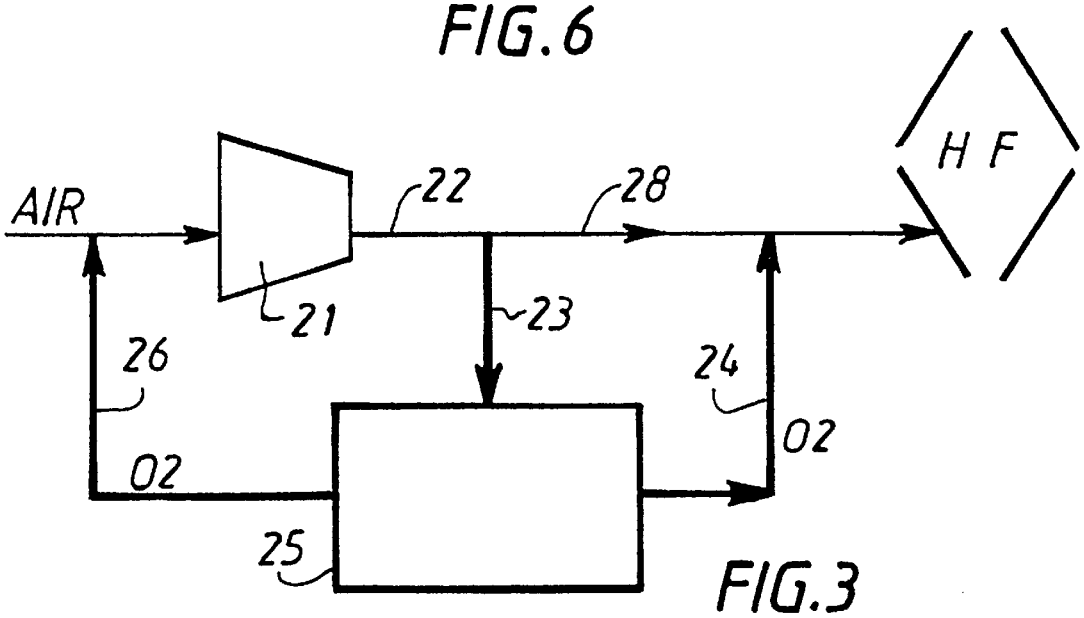

In FIG. 3, 200,000 $m^3$ (stp) per hour are sent to the blower 21. The blast furnace HF needs to be fed with air enriched to 25% with respect to oxygen, which represents a demand of 350 t per day of pure oxygen. The gas flow 22 compressed by the blower 21 is divided into two, the first part 28 being sent to the blast furnace HF, and the second part 23, i.e. a flow rate of 50,000 $m^3$ (stp) per hour being sent to a distillation apparatus 25 having two columns which are thermally connected in a conventional fashion.

This apparatus produces 120 t per day of low-pressure oxygen and 230 t per day of medium-pressure oxygen. The medium-pressure oxygen is combined with the flow 28, and the low-pressure oxygen is compressed in the blower 21.

Figure 4:
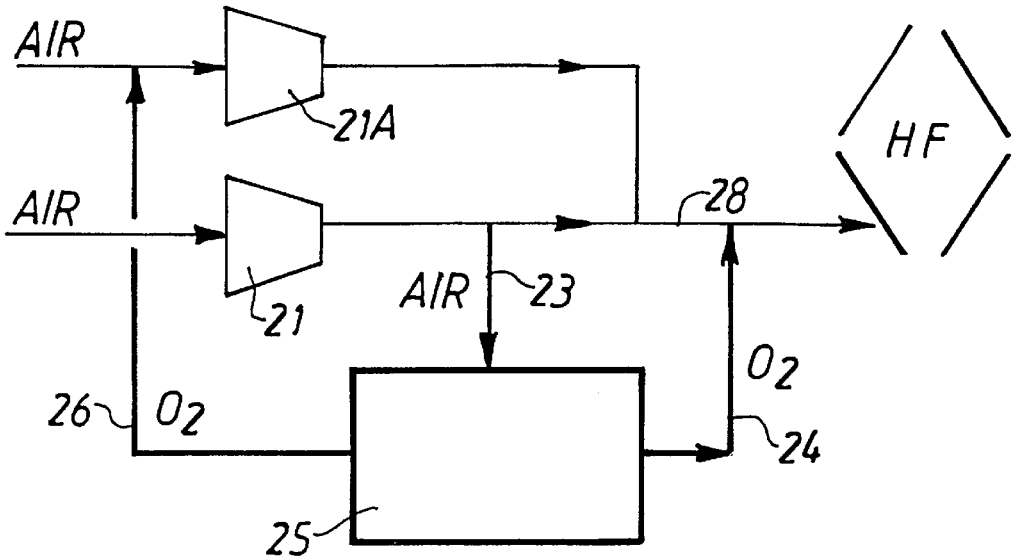

In the variant in FIG. 4, the blast furnace in FIG. 3 is fed using the same air separation apparatus, but two blowers 21, 21A are used, one 21 of which is used to feed the separation unit 25 and the consumer unit, and the other 21A is used to compress the low-pressure oxygen-enriched air.

In this way, the air can be compressed with blowers that may be of different sizes; only one of these blowers will need safety measures to avoid problems due to oxygen concentration. Therefore, the blower 21A compresses 98,300 $m^3$ (stp) per hour of oxygen-enriched air and the blower 21 compresses 145,000 $m^3$ (stp) per hour of air, of which 50,000 $m^3$ (stp) per hour are sent to the apparatus 25 (flow 23). The apparatus produces 3300 $m^3$ (stp) per hour of low-pressure oxygen, which are recycled to the blower 21A for compression therein, and 6700 $m^3$ (stp) per hour of medium-pressure oxygen (flow 24). The combined flow rates 28 and 24 constitute the 200,000 $m^3$ (stp) per hour of oxygen-enriched air needed for the blast furnace.

The compressed gas flow 22 is divided into two, the first part 28 being sent to a blast furnace HF and the second part 23 being sent to a double-column distillation unit 25. The distillation unit produces medium-pressure oxygen 24 which is combined with the flow 28, and low-pressure oxygen 26 which is compressed in the blower 21. Enriched air with 23% of oxygen is thus sent to the blast furnace.

In the variant in FIG. 4, two blowers 21, 21A feed the blast furnace. The low-pressure oxygen 26 is recycled to the blower 21A, and only the blower 21 sends air to the separation unit 25.

Figure 5:
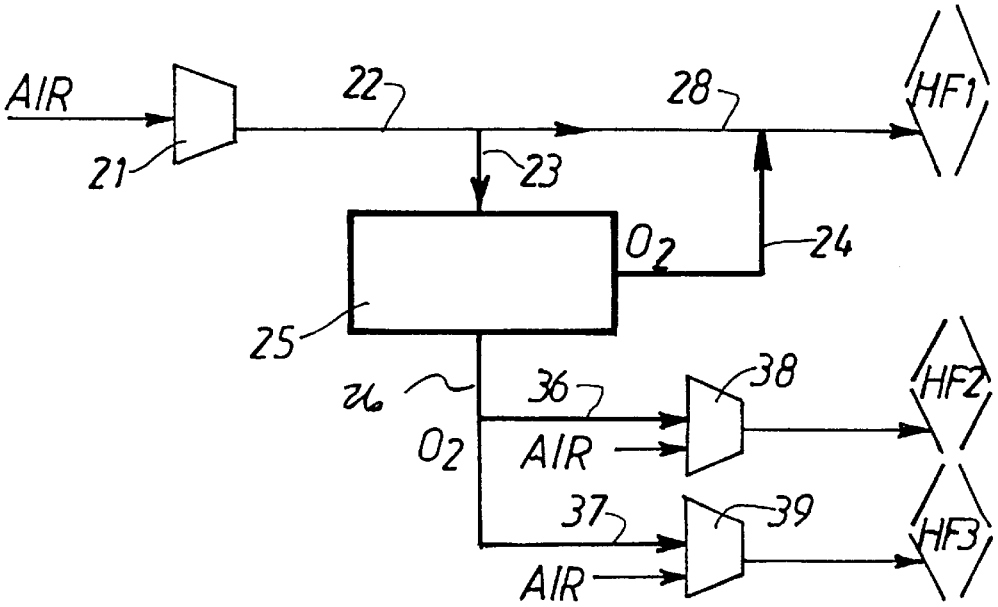

In the variant in FIG. 5, the low-pressure oxygen is separated into two flows 36, 37, each of which is compressed by a respective blower 38, 39 and sent to a blast furnace HF2, HF3. Air flows are also sent to the compressors 38, 39.

Figure 1:
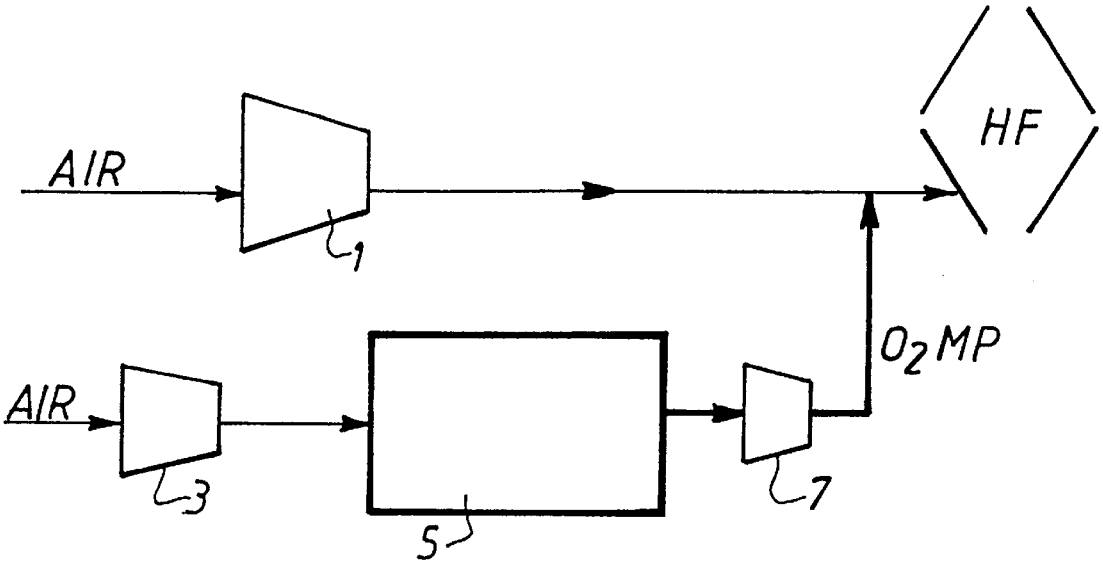
FIG.1 PRIOR ART
FIGS. 1 and 2 illustrate the prior art.
Figure 2:
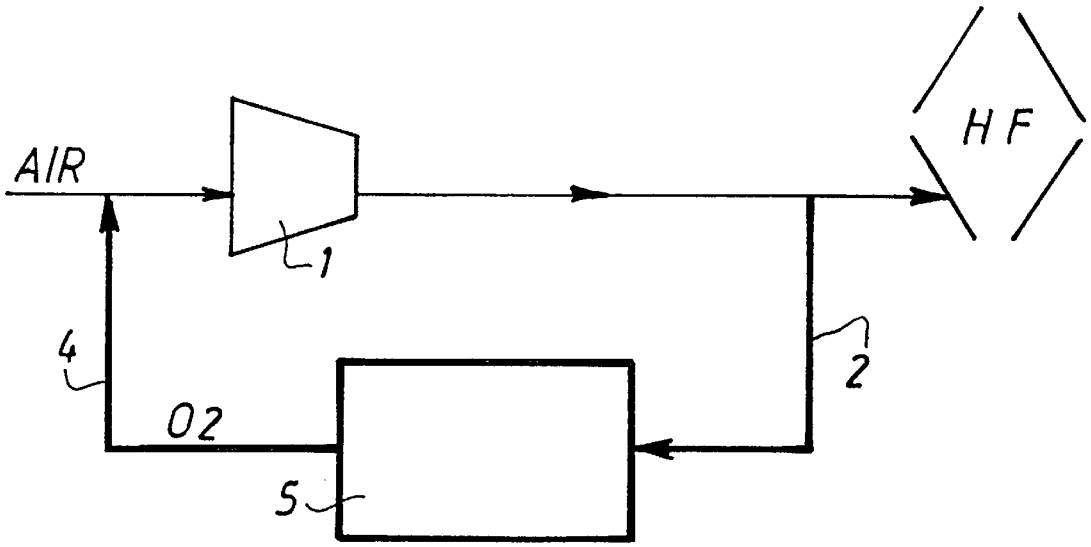
FIG.2 PRIOR ART
Figure 6:
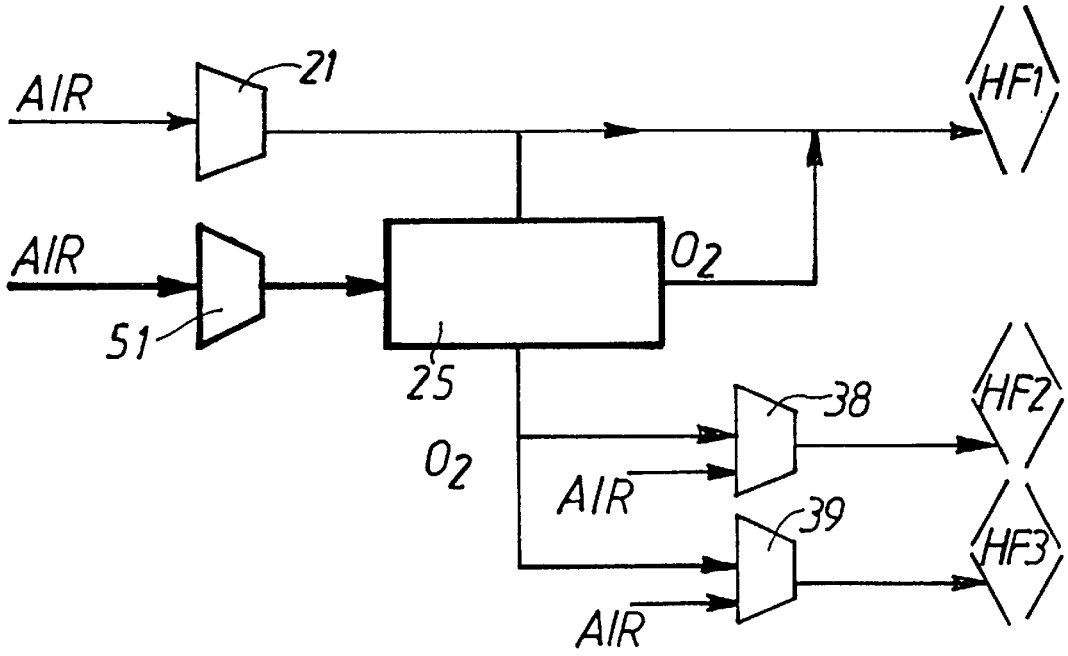
FIGS. 3 to 8 illustrate different embodiments of the invention.

The separation unit 25 may also be fed with an air flow delivered by a compressor 51 (see FIG. 6).

The medium-pressure oxygen may be produced by the vaporization of a liquid flow, optionally in a mixing column (direct heat exchange), or against a part of the feed air of the apparatus in an exchanger (indirect heat exchange).

The invention also applies to units consuming gases other than oxygen, and to other units consuming oxygen-enriched air, for example in glass furnaces and copper metallurgy units.

The other gases, for example nitrogen, produced by the separation apparatus may also be sent to the compressed gas-consuming unit of the invention.

Figure 7:
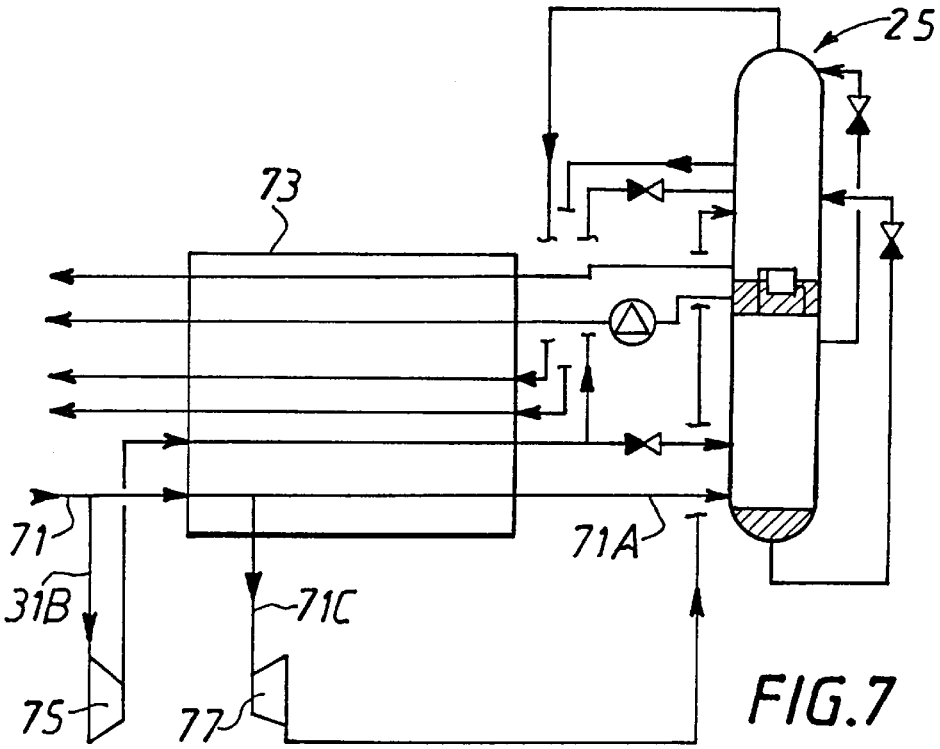

In FIG. 7, air 71 compressed to the pressure of the medium-pressure column is divided into three parts. The first part 71A is sent directly to the medium-pressure column. The second part 71B is compressed in a compressor 75, liquefied in exchange line 73 and sent to the medium-pressure column after expansion. The third part 71C is expanded in a blower turbine 77 and sent to the low-pressure column. Liquid oxygen is drawn from the low-pressure column, pumped and vaporized in the exchange line 73.

Figure 8:
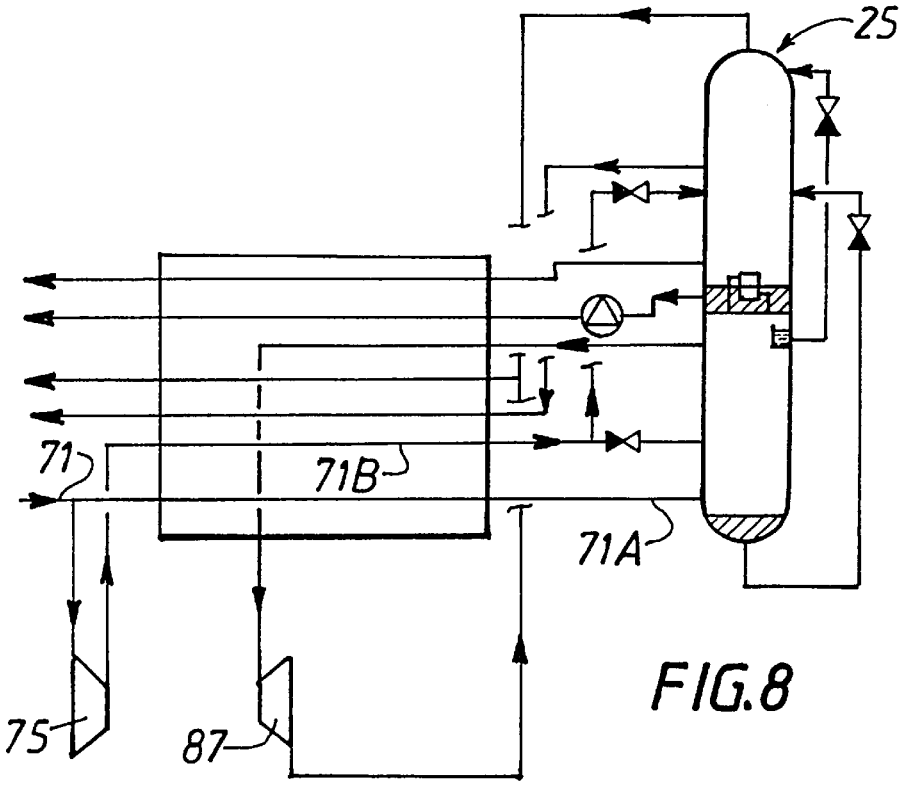

FIG. 8 contains the same elements as FIG. 7, except that the air blower turbine 77 is replaced by a medium-pressure nitrogen turbine 81. The compressed air 71B is liquefied and divided into two parts, one of which is sent to the medium-pressure column and the other to the low-pressure column.

What is claimed is:

1. Process for feeding a gas-consuming unit (HF), in which:

i) a feed flow consisting of a gas mixture is compressed in a compression unit (21);

ii) a first part (28) of the compressed mixture is sent to the gas-consuming unit (HF);

iii) a second part (23) of the compressed mixture is sent to a separation apparatus (25) which separates the mixture to produce two gas flows, one of which is at a higher pressure than the other;

iv) the gas flow (24) at higher pressure is sent to the gas-consuming unit (HF);

(v) the other gas flow at a lower pressure (26) is sent for compression to at least said compression unit (21), and the gas thus compressed is sent to at least one gas-consuming unit (HF, HF2, HF3); and (vi) the feed flow is air and said two gas flows are both enriched with the same one of nitrogen or oxygen.

2. Process according to claim 1, in which the two gas flows are sent to the same gas-consuming unit (HF).

3. Process according to claim 1, in which the other gas flow at a lower pressure and the, or one of the, feed flows are compressed in the same compression unit (21).

4. Process according to claim 1, in which a gas-consuming unit (HF) is fed with at least two feed flows compressed separately by compression units consisting of respective blowers (21, 21A).

5. Process according to claim 4, in which a first blower (21A) is fed by the other gas flow (26), and a part (23) of the feed flow compressed in a second blower (21) is sent to the separation unit (25).

6. Process according to one of the preceding claims, in which the separation unit (25) is also fed with air delivered by an air compressor (41, 51).

7. Process according to claim 1, in which the gas at higher pressure is produced by the gas-consuming unit (25) by vaporization of a liquid in direct or indirect heat exchange, optionally with a compressed air flow.

8. Process according to claim 1, in which the gas at higher pressure is compressed for this pressure.

9. Process according to claim 1, in which the air or the gas at higher pressure is compressed by a compressor driven by an expansion turbine of the separation unit (25).

10. Process according to claim 1, in which the separation unit (25) is a cryogenic distillation unit.

11. Process according to claim 1, according to which the gas-consuming installation (HF) is a blast furnace which consumes oxygen-enriched air.

12. Installation for feeding a gas-consuming unit (HF), comprising:

a compression unit (21), a gas-consuming unit, a unit (25) for separating a gas mixture, a means for sending a gas mixture to the compression unit, a means (22, 28) for sending a first part of the compressed mixture to the gas-consuming unit, a means (23) for sending a second part of the compressed mixture to the separation unit (25), a means (24) for sending a first gas, at higher pressure, from said separation unit to the gas-consuming unit (HF, HF1), a means (36, 38) for sending a second gas from said separation unit to at least said compression unit (26, 38, 39) and subsequently to at least one gas-consuming unit (HF, HF2, HF3), wherein the first gas and the second gas are both enriched with the same one of oxygen and nitrogen.

13. The process of claim 1, wherein the gas flow at higher pressure is mixed with the first part of the compressed mixture prior to being received by the gas-consuming unit (HF).

* * * * *